US006449876B1

(12) United States Patent
Pursell

(10) Patent No.: US 6,449,876 B1
(45) Date of Patent: Sep. 17, 2002

(54) CLOTHES DRYER

(76) Inventor: Robert Pursell, 7251 Pinebrook Cir., Las Vegas, NV (US) 89147

( * ) Notice: Subject to any disclaimer, the term of this patent is extended or adjusted under 35 U.S.C. 154(b) by 0 days.

(21) Appl. No.: 09/798,297

(22) Filed: Mar. 5, 2001

(51) Int. Cl.[7] ..... F26B 19/00; F26B 11/02

(52) U.S. Cl. ..... 34/595; 34/93; 34/108; 34/121; 34/602

(58) Field of Search ..... 34/572, 93, 108, 34/110, 121, 122, 126, 130, 595, 598, 596, 601, 602, 603, 608, 184, 639

(56) References Cited

U.S. PATENT DOCUMENTS

| | | | | | |
|---|---|---|---|---|---|
| 629,644 | A | * | 7/1899 | Axtell | 34/108 |
| 1,284,007 | A | * | 11/1918 | Whitcomb | 34/130 |
| 1,381,243 | A | * | 6/1921 | Seymour | 34/321 |
| 1,707,015 | A | * | 3/1929 | Jones | 34/108 |
| 1,763,462 | A | * | 6/1930 | Gabbe | 34/108 |
| 3,121,000 | A | * | 2/1964 | Hubbard | 34/75 |
| 3,263,343 | A | * | 8/1966 | Loos | 34/82 |
| 3,457,656 | A | * | 7/1969 | Fox | 34/133 |
| 4,071,961 | A | * | 2/1978 | Dietzel | 34/108 |
| 4,091,546 | A | * | 5/1978 | Bochan | 34/73 |
| 4,236,322 | A | * | 12/1980 | Hastings | 34/130 |
| 4,240,210 | A | * | 12/1980 | Huang | 34/39 |
| 4,245,398 | A | * | 1/1981 | Poisson | 34/93 |
| 5,636,453 | A | * | 6/1997 | Stacik et al. | 34/601 |
| 5,746,070 | A | * | 5/1998 | Bailey et al. | 68/24 |
| 5,809,663 | A | * | 9/1998 | Perque | 34/93 |
| 6,151,797 | A | * | 11/2000 | Fleissner | 34/115 |
| 6,154,978 | A | * | 12/2000 | Slutsky | 34/321 |

* cited by examiner

*Primary Examiner*—Ira S. Lazarus
*Assistant Examiner*—Kenneth B. Rinehart
(74) *Attorney, Agent, or Firm*—Leonard Weiss

(57) ABSTRACT

A drum made from a wire mesh is axially rotatable whereby wet clothes in the drum tumble when the drum is rotated. A motor is mounted on a platform beneath the drum. The motor has fan blades mounted on its shaft that provide a flow of air to the drum when the shaft rotates. A friction coupling of the drum to the motor is used to rotate the drum. When the shaft does not rotate, power is provided to the motor through two capacitors that are in parallel. When the motor starts, a sail switch causes a break in an ohmic connection between one of the capacitors and the motor.

3 Claims, 2 Drawing Sheets

CLOTHES DRYER

BACKGROUND OF THE INVENTION

1. Field of Invention

This invention is in the general field of laundry appliances and, more particularly, is a clothes dryer.

2. Description of the Prior Art

A clothes dryer usually includes a drum wherein wet clothes are placed. The drum is axially rotated by a drum motor, thereby tumbling the wet clothes as they are dried.

The clothes dryer additionally includes a blower motor that drives a blower that causes a flow of air over a heating coil where it is heated. The heated air is directed into the drum where it evaporates water from the wet clothes.

A control system of the clothes dryer includes controls for establishing a drying cycle with a specified heat level and a drying time. The drying cycle is initiated by placing the wet clothes in the drum, manually adjusting controls of the control system to specify the heat level and the drying time and depressing a start button. In response to the depression of the start button, the drum motor, the blower motor and the heating coil are energized for a time duration equal to the drying time.

The heating coil is usually an electric resistance heater. In order to adequately sanitize the wet clothes, the heater would have to operate at a temperature that is likely to cause damage to the wet clothes as they dry. Therefore, the dryer is not used to sanitize clothes. There is a need for a dryer that sanitizes clothes.

Power provided the dryer is on the order of several kilowatts and is primarily consumed by the heating coil. A lesser amount of power is consumed by the drum motor and the blower motor. Because electric power is provided at an ever increasing cost, it is desirable to reduce the power needed to dry clothes.

SUMMARY OF THE INVENTION

According to the present invention, a drum made from a wire mesh is axially rotatable. A motor disposed proximal to the drum has a shaft whereon fan blades rotate to cause a flow of air into the drum. An annulus is fixedly connected to the drum with the drum and the annulus being coaxial. There is a friction coupling between the shaft and the annulus that causes the drum to rotate in response to rotation of the shaft.

The invention is a dryer is particularly suited for use out of doors where ultraviolet rays of sunlight sanitize clothes as they dry. The dryer uses on the order of sixty watts of power because it includes only one motor and does not include a heater. When there are dry ambient climactic conditions, it is desirable to use the invention to dry clothes indoors and thereby cause an increase in ambient humidity.

Other objects, features and advantages of the invention should be apparent from the following description of the preferred embodiment thereof as illustrated in the accompanying drawing.

DESCRIPTION OF THE PREFERRED EMBODIMENT

Figure 1:
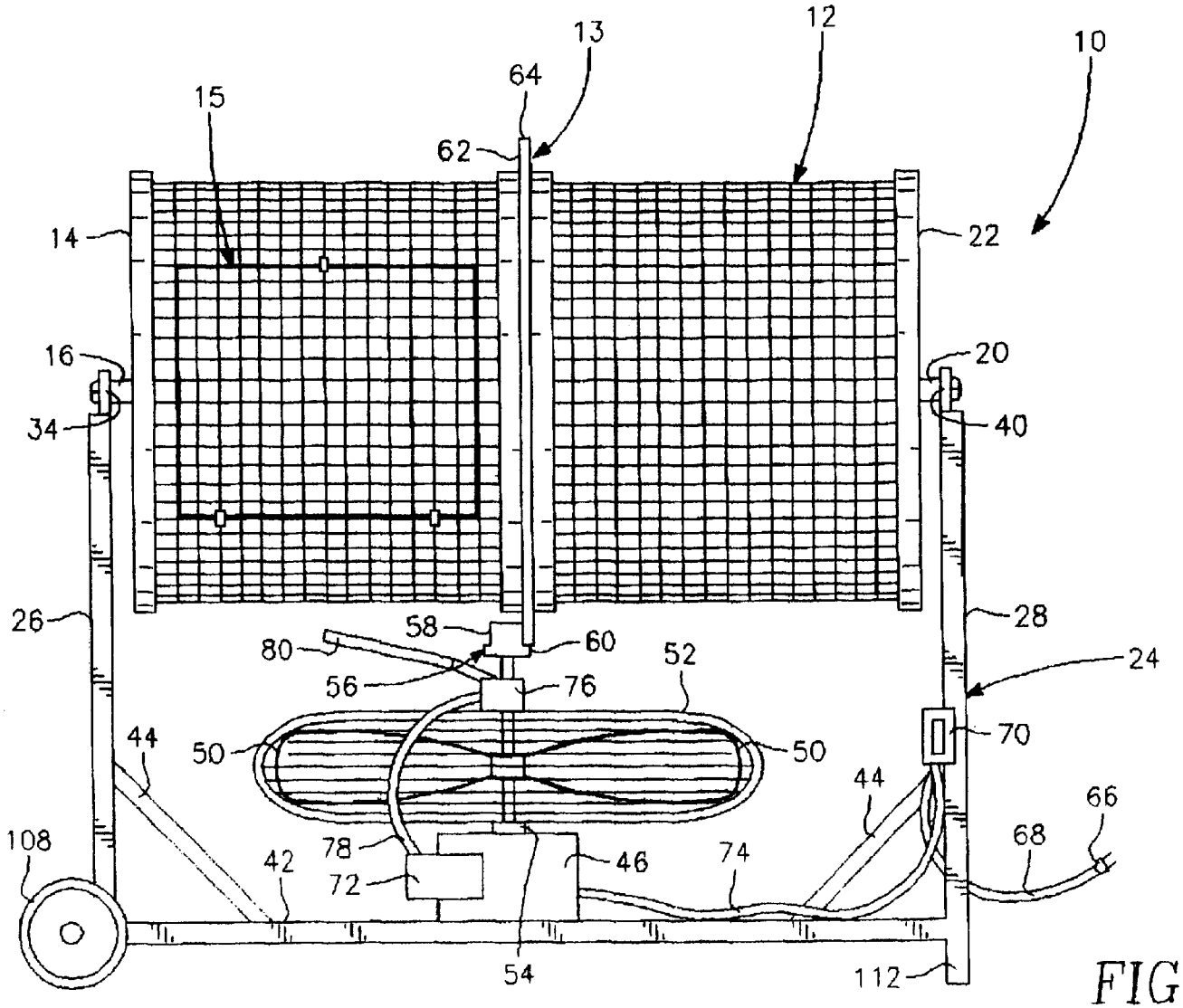
FIG. 1 is a side view of the preferred embodiment of the present invention.
Figure 2:
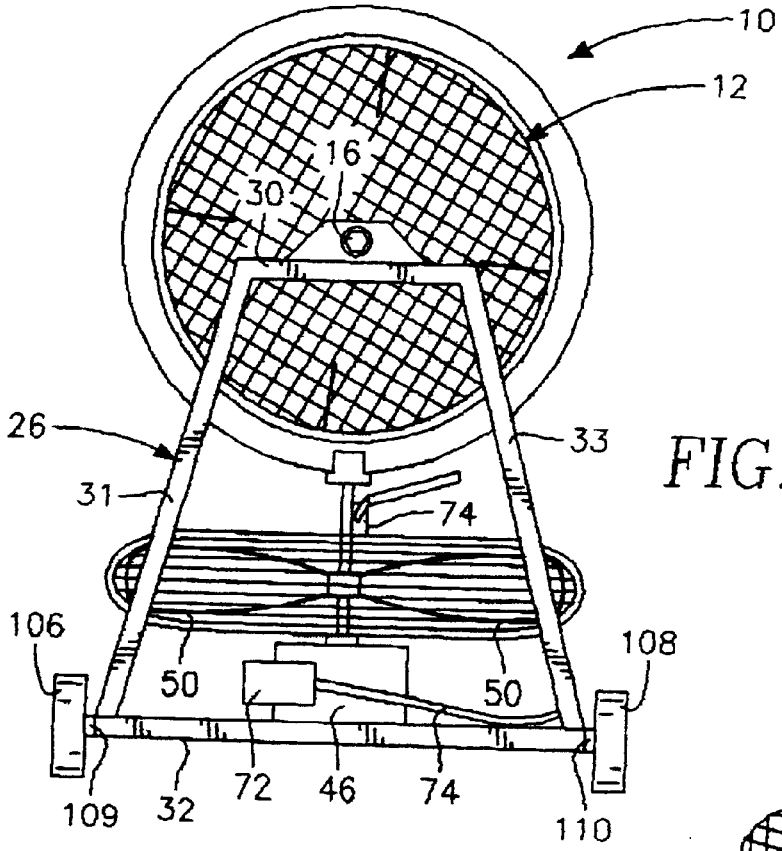
FIG. 2 is an end view of the embodiment of FIG. 1.
Figure 3:
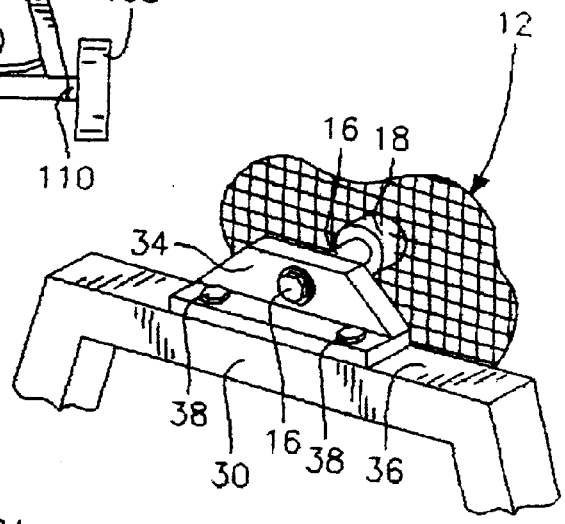
FIG. 3 is a perspective view of a rod that is connected to an end of a wire cage in the embodiment of FIG. 1.

As shown in FIGS. 1–3, a clothes dryer 10 includes of a wire mesh drum 12 that is primarily made from plastic covered wire. Wet clothes are placed in the drum 12 through a door 13 that is manually opened and closed.

A metal annulus 14 is connected about the drum 12. The annulus 14 is a sheet with surface 15, 16 and an edge 17. The annulus 14 and the drum 12 are coaxial.

As explained hereinafter, when the door 13 is closed, the annulus 14 is used to cause the drum 12 to be axially rotated, thereby causing the clothes to tumble. Spacing between adjacent wires of the mesh is on the order of one-half inch to prevent buttons of from passing through the mesh during the tumbling.

The drum 12 has an end 18 where a rod 19 is fixedly connected via a connection element 20 (FIG. 3). The drum 12 and the rod 19 are coaxial. In a similar manner, a rod 21 is connected to an end 22 of the drum 12.

A support structure 24 of the clothes dryer 10 has similar ends 26, 28. (FIG. 1) that have the shape of a trapezoid. The end 26 has an upper member 30 and a lower member 32 that are parallel. The members 30, 32 are horizontal. The end 26 additionally has non-parallel members 31, 33 that are of equal length.

A bearing housing 34 (FIG. 3) is centrally disposed on a top surface 36 of the member 30. The disposition of the housing 34 is maintained by bolts 38 that pass through holes in the housing 34 and the member 30. The bolts 38 screw into nuts (not shown ) on a bottom surface (not shown) of the member 30. The rod 19 passes through the housing 34 where it is journalled in bearings. In a similar manner, the rod 21 is journalled in bearings of a bearing housing 40 (FIG. 1) whereby the drum 12 is rotatable about its axis (not shown).

A horizontal platform 42 is maintained in any suitable manner beneath the drum 12 between the lower member 32 and a lower member (not shown) of the end 28. Preferably, four struts 44 (two shown) reinforce a connection of the platform 42 to the ends 26, 28.

A motor 46 is fixedly mounted on the platform 42. The motor 46 has a shaft 48 that extends vertically. Fan blades 50 are connected to the shaft 48, thereby causing the fan blades 50 to provide a flow of air to the drum 12 in response to a rotation of the shaft 48. The fan blades 50 are within a metal cage 52 that is connected to a mounting fixture 54. The cage prevents an inadvertent contact between the fan blades 50 and a person near the dryer 10.

A friction coupling of the drum 12 to the motor 46 is used to rotate the drum 12. The friction coupling is provided by the annulus 14 and a rubber knob 56 that is connected to a distal end of the shaft 48. The knob 56 is comprised of a cylindrical body 58 having an end integrally connected to a lip 60.

The body 58 and the lip 60 are in contact with the surface 15 and the edge 17, respectively. Because of the contact with the surface 15 and the edge 17, when the shaft 48 rotates, the drum 12 is made to rotate. Therefore, in accordance with the present invention, a motor that causes a flow of air over the wet clothes also causes the wet clothes to tumble.

A plug 66 is connectable to a conventional 115 volt 60 cycle power source (not shown). The plug 66 is connected through a power line 68 to an ON-Off switch 70 that is mounted on the end 28. The switch 68 is connected to a start box 72 through a power line 74. When the plug 66 is connected to the power source, the switch 70 is used to control an application of power to the motor 46.

Elements within the start box 72 are connected to a micro switch 76 through a power line 78 and to the motor 46. The micro switch 76 is connected to a sail element 80. In response to a flow of air from the blades 50, the sail 80 causes contacts of the switch to open. In other words, the switch 76 and the sail 80 comprise a sail switch. Sail switches are well known to those skilled in the art.

Figure 4:
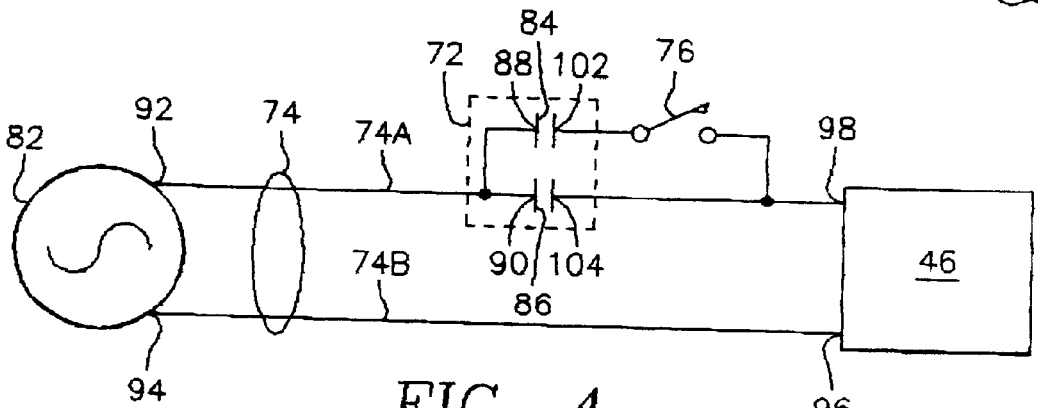
FIG. 4 is a schematic showing of an input circuit of a motor in the embodiment of FIG. 1.

As shown in FIG. 4, a voltage source 82 is a schematic representation of apparatus that provides electrical power to the motor 46 via the start box 72. Within the start box 72 a capacitor 84 and a capacitor 86. The capacitor 84 has a terminal 88 that is connected to a terminal 90 of the capacitor 86. The terminals 88, 90 are connected to an output terminal 92 of the voltage source 82 through a line 74A of the power line 74.

Electrical power is provided to the motor 46 at input terminals 96, 98. A terminal 94 of the voltage source 82 is connected to the terminal 96 through a line 74B of the power line 74. A terminal 102 of the capacitor 84 is connected to the terminal 98 through contacts of the switch 76. More particularly, prior to the fan blades 50 providing the flow of air that causes the contacts of the switch to open, there is an ohmic connection between the terminal 102 and the terminal 98; the ohmic connection is broken in response to the flow of air. A terminal 104 of the capacitor 86 is connected to the terminal 98.

From the explanation given hereinbefore, when there is no flow of air from the blades 50, the capacitors 82, 84 are in parallel; the flow of air causes the break of the ohmic connection between the capacitor 84 and the terminal 98 thereby substantially eliminating the capacitor 84.

Typically, the capacitors 84, 86 have values of five microfarads and ten microfarads, respectively. Therefore, when the capacitors 84, 86 are in parallel, fifteen microfarads is provided. When the capacitor 84 is eliminated, five microfarads id provided. The fifteen microfarads is desirable when voltage is initially applied to the motor 46 because it causes the motor 46 to provide an increased starting torque.

The dryer 10 has wheels 106, 108 that are rotatably mounted on members 109, 110, respectively, that extend from the member 32. Additionally, legs 112 extend from non parallel members of the end 28. The wheels 106, 108 facilitate portability of the dryer 10. The legs 112 cause the axis of the drum 12 to be horizontal.

While the invention has been particularly shown and described with reference to a preferred embodiment, it should be understood by those skilled in the art that changes in form and detail may be made therein without departing from the spirit and scope of the invention.

I claim:

1. A clothes dryer, comprising:

an axially rotatable wire mesh drum wherein clothes are placed for drying, said wire mesh passing ultraviolet rays of sunlight to said clothes when the clothes dryer is used out of doors;

a motor disposed proximal to said drum;

means for axially rotating said drum in response to rotation of a shaft of said motor;

a plurality of fan blades connected to said motor shaft; and a platform beneath said drum where said motor is mounted with said motor shaft extending vertically.

2. A clothes dryer, comprising:

an axially rotatable wire mesh drum wherein clothes are placed for drying, said wire mesh passing ultraviolet rays of sunlight to said clothes when the clothes dryer is used out of doors;

a motor disposed proximal to said drum;

an annulus made from a sheet, said annulus being connected about said drum with said annulus and said drum coaxial; and a rubber knob having a cylindrical body with an end integrally connected to a lip, said knob being connected to a distal end of said motor shaft with said body and said lip in contact with a surface and an edge, respectively, of said annulus; and means for providing a flow of air into said drum in response to rotation of said motor shaft.

3. A clothes dryer, comprising:

an axially rotatable wire mesh drum wherein clothes are placed for drying, said wire mesh passing ultraviolet rays of sunlight to said clothes when the clothes dryer is used out of doors;

a motor disposed proximal to said drum;

means for axially rotating said drum in response to rotation of a shaft of said motor;

means for providing a flow of air into said drum in response to rotation of said motor shaft; and a capacitor connected between a power line and a power input of said motor through contacts of a sail switch.

* * * * *